US008851469B2

(12) United States Patent
Adachi

(10) Patent No.: US 8,851,469 B2
(45) Date of Patent: Oct. 7, 2014

(54) SHEET CONVEYING APPARATUS

(71) Applicant: Canon Kabushiki Kaisha, Tokyo (JP)

(72) Inventor: Noriaki Adachi, Inzai (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/889,197

(22) Filed: May 7, 2013

(65) Prior Publication Data

US 2013/0307213 A1 Nov. 21, 2013

(30) Foreign Application Priority Data

May 15, 2012 (JP) ..... 2012-111730

(51) Int. Cl.
*B65H 7/02* (2006.01)
*B65H 7/14* (2006.01)

(52) U.S. Cl.
CPC ..... *B65H 7/14* (2013.01)
USPC ..... 271/227; 271/230; 271/265.01

(58) Field of Classification Search
USPC ..... 271/227, 230, 265.01
See application file for complete search history.

(56) References Cited

U.S. PATENT DOCUMENTS

| | | | | |
|---|---|---|---|---|
| 7,472,905 | B2 * | 1/2009 | Inoue | 271/227 |
| 8,079,589 | B2 | 12/2011 | Kinoshita et al. | |
| 2007/0284810 | A1 * | 12/2007 | Nakazawa et al. | 271/228 |
| 2013/0277909 | A1 * | 10/2013 | Koichiro | 271/228 |

FOREIGN PATENT DOCUMENTS

| | | | |
|---|---|---|---|
| JP | 05-124752 | A | 5/1993 |
| JP | 2002-248804 | A | 9/2002 |

* cited by examiner

*Primary Examiner* — Michael McCullough
(74) *Attorney, Agent, or Firm* — Canon USA, Inc. IP Division

(57) ABSTRACT

A sheet conveying apparatus irradiates a conveyed sheet with light from a light source to receive reflected light by a line sensor and detects a side edge position of the sheet based on an output of a reading pixel of the line sensor. The reading pixel within a predetermined range facing the sheet in the line sensor is determined to be used for light quantity adjustment of the light source based on a size in a width direction orthogonal to a sheet conveying direction, and the light quantity of the light source is adjusted based on the output of the determined reading pixel. A threshold value for detecting the side edge position of the sheet is determined based on outputs of reading pixels within the region facing the sheet and outputs of the reading pixels within the region not facing the sheet in the line sensor.

20 Claims, 8 Drawing Sheets

SHEET CONVEYING APPARATUS

BACKGROUND OF THE INVENTION

1. Field of the Invention

The present invention relates to a sheet conveying apparatus and an image forming apparatus having a function of detecting a sheet position in a width direction orthogonal to a conveying direction of a sheet.

2. Description of the Related Art

In an image forming apparatus, skewing, a position displacement, and the like may occur when a sheet is fed from a sheet feeding cassette due to a misalignment of a sheet position loaded in the cassette, a slip between a conveying roller and the sheet at the time of conveying the sheet, and the like. As a result, a relative positional displacement between an image transferred onto a sheet and the sheet occurs, and an image may not be formed in a predetermined position of the sheet.

In order to transfer an image to a predetermined position of a sheet, a skew correction mechanism for sheets or a lateral position correction mechanism for correcting the position of a sheet in a direction (width direction) orthogonal to a conveying direction is mounted.

U.S. Pat. No. 8,079,589 discusses an image forming apparatus including a skew correction mechanism for correcting skewing of a sheet with respect to the conveying direction by causing the leading edge of the sheet to contact a registration roller disposed upstream in a sheet conveying direction.

Further, Japanese Patent Application Laid-Open No. 05-124752 discusses an image forming apparatus in which a side edge position of a sheet is detected by a line sensor, such as, for example, a contact image sensor, and a lateral position correction mechanism moves a roller that conveys the sheet in an axial direction thereof so that the side edge position becomes a predetermined position.

In an image forming apparatus including both the above-described skew correction mechanism and the lateral position correction mechanism, a registration roller may be configured to have two functions, a skew correction function and a lateral position correction function. Further, the upstream side or downstream side of the registration roller is provided with a line sensor for detecting the side edge position of a sheet, and the upstream side of the registration roller and the line sensor is provided with a conveying roller for conveying the sheet to the registration roller.

A sheet material is bent by causing the leading edge of the sheet conveyed by a conveying roller to contact the registration roller in the state in which the registration roller stops, such that the skewing of the leading edge of the sheet is corrected. Next, by rotating the registration roller, the side edge position of the sheet is detected by the line sensor in the state in which the sheet is not bent, and the registration roller is shifted in an axial direction thereof according to the detected side edge position to correct the lateral position of the sheet.

Further, Japanese Patent Application Laid-Open No. 2002-248804 discusses a configuration in which a comparator compares an analog output for one line of the line sensor with a threshold value, and the side edge position of the sheet is detected according to the time from when the comparison is started until an output of the comparator is changed.

When the side edge position of the sheet is detected using a light source and the line sensor, outputs from each pixel of the line sensor facing the vicinity of the side edge position of the sheet are changed with an inclination due to a diffused reflection from a sheet surface. Therefore, it is desirable that the threshold value of the comparator is set to be a midpoint between a detection level of a sheet region and a detection level of a region outside the sheet region.

Further, in order for the line sensor to detect the side edge position of the sheet with high precision, there is a need to perform a light quantity adjustment. In the light quantity adjustment, the light quantity is adjusted so as to prevent a maximum value of the outputs from each pixel of the line sensors from being saturated. In addition, a midpoint between an average value of the outputs from each pixel of a region facing the sheet and an average value of the outputs from each pixel of a region outside the sheet region is determined as the threshold value.

However, the sheet being conveyed is nipped by a plurality of roller pairs disposed apart from each other in a width direction, so that the sheet is in a waving state in a width direction. Therefore, a distance between the line sensor and the sheet is changed according to the position of the sheet in the width direction. For this reason, when the distance between the sheet and the line sensor at the side edge position of the sheet is longer than the distance between the sheet and the line sensor at positions other than the side edge position, the side edge position of the sheet may not be detected with high precision.

SUMMARY OF THE INVENTION

The present invention is directed to an image forming apparatus which detects a side edge position of a sheet with high precision to correct a lateral position of the sheet.

Further, the present invention is directed to an image forming apparatus which determines a threshold value for detecting a side edge position of a sheet with high precision.

According to an aspect of the present invention, a sheet conveying apparatus includes a conveying unit configured to convey a sheet, an acquisition unit configured to acquire a size of the sheet in a width direction orthogonal to a conveying direction of the sheet, a light source configured to irradiate the sheet with light, a line sensor configured to receive light from the light source and including a plurality of reading pixels for detecting a side edge position of the sheet in the width direction, a determination unit configured to determine the reading pixels within a predetermined range facing the sheet in the line sensor as reading pixels to be used for light quantity adjustment of the light source based on the size acquired by the acquisition unit, a light quantity adjustment unit configured to adjust a light quantity of the light source based on outputs from the reading pixels determined by the determination unit, a threshold value determination unit configured to determine, after the light quantity is adjusted by the light quantity adjustment unit, a threshold value for detecting the side edge position of the sheet based on outputs from the reading pixels within the region facing the sheet in the line sensor and outputs from reading pixels within a region not facing the sheet, and a position detection unit configured to detect the side edge position of the sheet based on outputs from the plurality of reading pixels of the line sensor and the threshold value determined by the threshold value determination unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

However, unless specifically described, dimensions, the scope of the present invention is not limited to materials, shapes, relative dispositions, and the like, of components disclosed in the exemplary embodiment.

Figure 1:
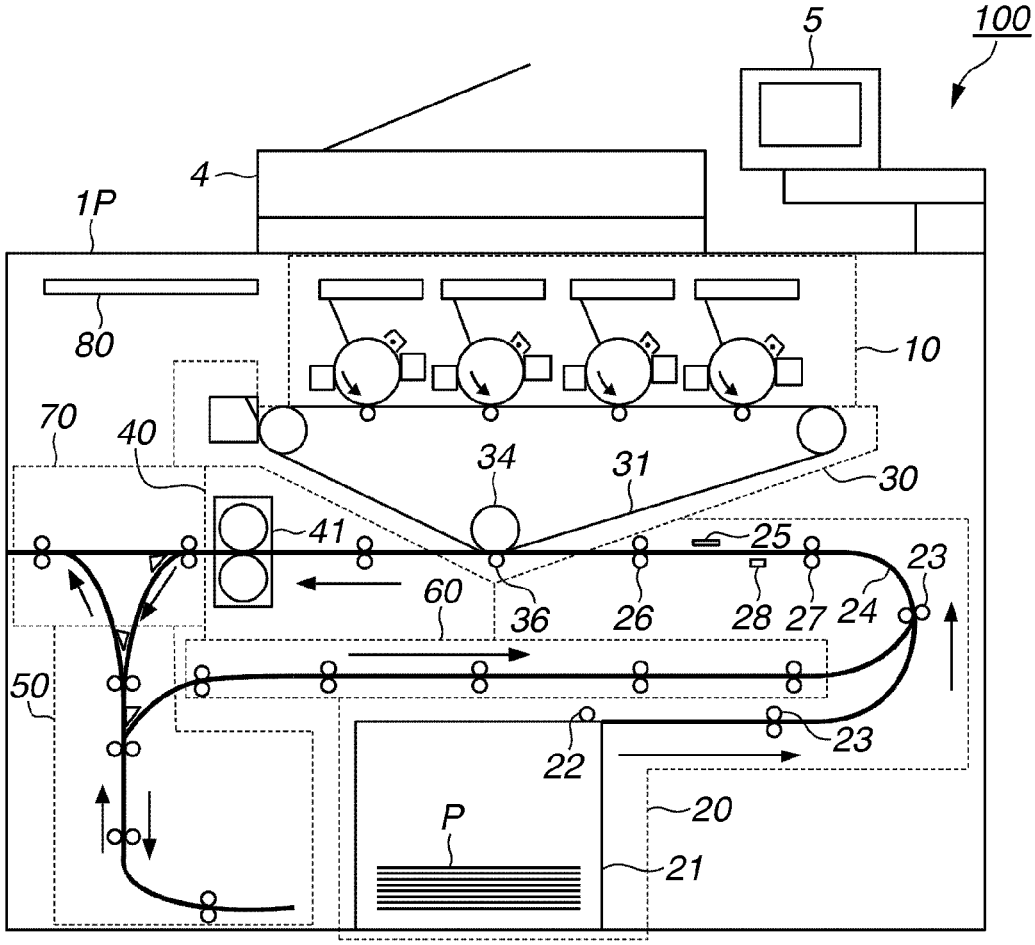
FIG. 1 is a cross-sectional view illustrating a configuration of an image forming apparatus according to an exemplary embodiment of the present invention.

In FIG. 1, an image forming apparatus 100 includes a sheet conveying apparatus including a sheet position detection device. Herein, a sheet conveying apparatus for the image forming apparatus 100 is described as a sheet conveying apparatus, but the present invention may be applied to any conveying apparatus that needs to detect a side edge position of the sheet. As an example of the image forming apparatus 100, an electro-photographic copying machine is described, but the present invention may also be applied to a printer or a facsimile machine forming a multicolor image or a monochromatic image. Further, the sheet may be called paper, a recording material, a transfer material, and transfer sheet.

An image output unit 1P includes a printer engine unit that forms an image of a document acquired by a reader unit 4 on a sheet P according to an instruction input from an operation unit 5. The image output unit 1P includes an image forming unit 10 that forms a toner image, a conveying unit 20 that feeds the sheet P to a conveying path from a sheet feeding cassette 21, an intermediate transfer unit 30 that transfers the toner image to the sheet P, and a fixing unit 40 that fixes the toner image onto the sheet P. Further, the image output unit 1P may optionally include a two-sided reversal unit 50 that reverses the front and back surfaces of the sheet P for performing two-sided printing on the sheet P and a two-sided conveying unit 60 that conveys the sheet P of which the front and back surfaces are reversed. The image output unit 1P also includes a sheet discharging unit 70 that discharges the sheet P and a control device 80. The control device 80 controls operations of each unit included in the image forming apparatus 100.

The conveying unit 20 is a sheet conveying apparatus that conveys the sheet P. The sheet P stored in the sheet feeding cassette 21 is delivered to the conveying path by a pick-up roller 22 one by one. The conveying path includes a black conveying guide 24 having a lower optical density, compared with the sheet P. The conveying path is provided with a plurality of conveying roller pairs 23 that nip and convey the sheet P. A registration roller pair 26 is a pair of rollers for conveying the sheet P, fitting a transfer timing of the toner image. The registration roller pair 26 has the skew correction function and the lateral position correction function as described above. Skewing of the sheet P is corrected by causing a leading edge of the sheet P to contact the registration roller pair 26 in the state in which a rotation of the registration roller pair 26 stops. That is, two side edges (lateral sides) of the sheet P become parallel with the conveying direction. Further, in the conveying direction of the sheet P, the leading edge may be called an upper end in the conveying direction, the trailing edge may be called a lower end. That is, four sides constituting a rectangular sheet P are an upper end (upper side/leading edge), a lower end (lower side/trailing edge), and two side edges (left side and right side). In addition, the registration roller pair 26 moves in parallel in a lateral direction (direction orthogonal to a conveying direction) in the state in which the sheet P is nipped therebetween, such that the position of the side edge of the sheet P is corrected to a predetermined position.

In the conveying path, a conveying roller pair 27, which is closable and openable, a sheet sensor 28 for detecting the presence or absence of the sheet P on the conveying path, and a line sensor 25 for detecting the side edge position of the sheet P are mounted between the conveying roller pair 23 and the registration roller pair 26. The line sensor 25 is disposed along a width direction intersecting the conveying direction of the sheet. The line sensor 25 is an example of a light detection unit that includes a plurality of elements each including a plurality of reading pixels arranged in a row and detects reflected light or transmitted light from the sheet P. The conveying roller pair 27 is closed at the time of conveying the sheet P to nip the sheet P therebetween. Meanwhile, the conveying roller pair 27 is opened at the time of correcting the side edge position of the sheet P to release the sheet P from the conveying roller pair 27.

The intermediate transfer unit 30 includes an intermediate transfer belt 31 that conveys the toner image and a pair of transfer rollers 34 that transfers the toner image to the sheet P. The pair of transfer rollers 34 includes two rollers and the intermediate transfer belt 31 and the sheet P are nipped by the two rollers.

The fixing unit 40 fixes the toner image transferred to the sheet P onto the sheet P. The sheet discharging unit 70 discharges the sheet P with the fixed toner image to the outside of the image forming apparatus 100. The two-sided reversal unit 50 draws the sheet P with an image formed on a front surface thereof and transmits the sheet P to the two-sided conveying unit 60 to invert the front and rear of the sheet P. The two-sided conveying unit 60 conveys the sheet P to the foregoing conveying path. The skew correction and the lateral position correction are also performed on the sheet P conveyed by the two-sided conveying unit 60.

Figure 2A:
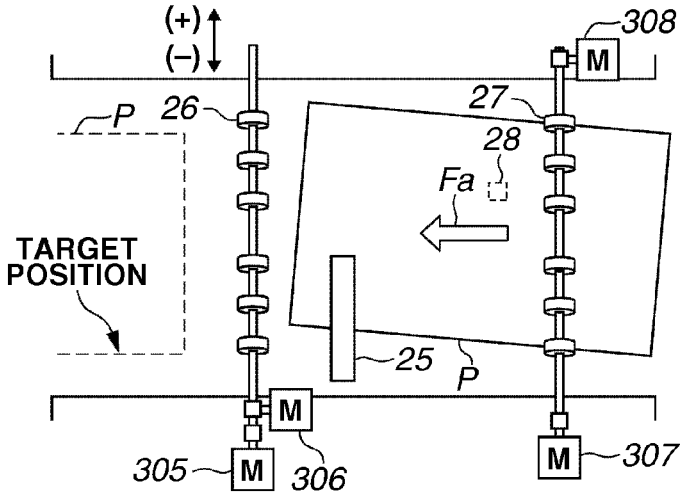
FIGS. 2A, 2B, and 2C are diagrams illustrating skew correction and lateral position correction.
Figure 2B:
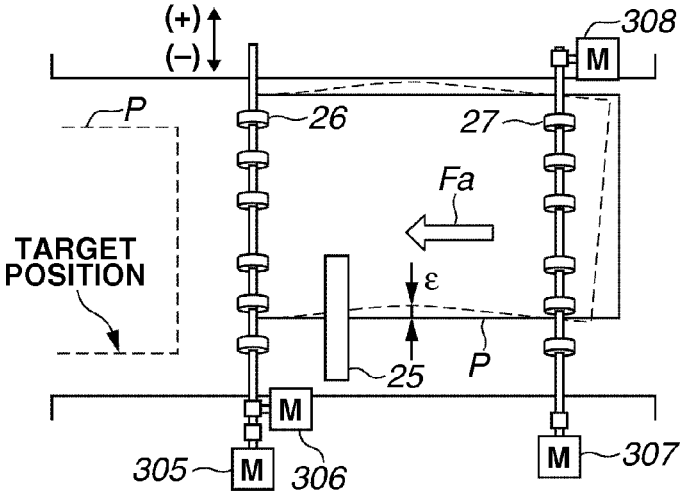

The skew correction and the lateral position correction will be described in more detail with reference to FIGS. 2A to 2C. In FIG. 2A, the registration roller pair 26 is driven by a registration driving motor 305 so as to rotate. Further, the registration roller pair 26 is driven by a shift motor 306 to move in parallel in a width direction Fb orthogonal to a conveying direction Fa. The conveying roller pair 27 is driven by a conveying driving motor 307 so as to rotate. The conveying roller pair 27 is driven by an opening and closing motor 308 to close or open two rollers constituting the conveying roller pair 27. Opening the conveying roller pair 27 may be called release or separation.

As illustrated in FIG. 2A, the sheet P is conveyed onto the conveying path by the rotation of the conveying roller pair 27.

When the sheet P reaches the registration roller pair 26, the registration roller pair 26 stops. Even after the sheet P contacts the stopping registration roller pair 26, the conveying roller pair 27 continuously rotates, such that the sheet P is bent (a loop is formed) like a dotted line in FIG. 2B. When the line sensor 25 detects the side edge position of the bent sheet P, an error $\epsilon$ occurs as illustrated in FIG. 2B. For this reason, the detection of the side edge position is performed in the state in which the sheet P approximately returns flatly.

The sheet is pushed in a conveying direction Fa by the rigidness of the bent sheet P while a leading edge of the sheet P contacts the registration roller pair 26 in the state in which the sheet P is bent. As a result, in the leading edge (front end) of the sheet P, the skewing of the sheet P is corrected. Meanwhile, as illustrated in FIG. 2B, the trailing edge of the sheet P is nipped between the conveying roller pair 27 and the trailing edge of the sheet P is skewed. In this state, if the conveying roller pair 27 is set to a separated state, there will be no pair of rollers nipping the sheet P. Therefore, the registration roller pair 26 rotates before the conveying roller pair 27 is set to the separated state. After the registration roller pair 26 nips the sheet P therebetween, the conveying roller pair 27 is set to the separated state. As illustrated in FIG. 2C, when the conveying roller pair 27 is set to the separated state, the skew is corrected in the entire sheet P.

Figure 2C:
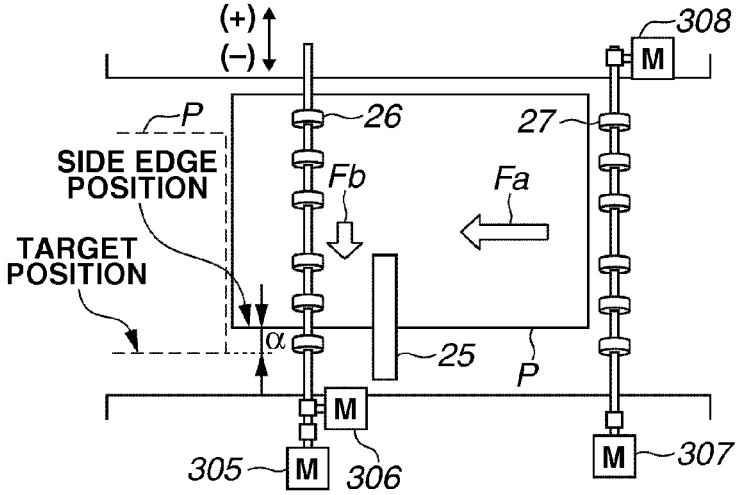

As illustrated in FIG. 2C, the light quantity adjustment of the line sensor 25 is performed in the state in which the skewing of the sheet P is corrected and the line sensor 25 detects the side edge position of the sheet P. A longitudinal direction of the line sensor 25 is orthogonal to the conveying direction Fa. A displacement amount $\alpha$ of the side edge position to a target position is obtained by detecting the side edge position of the sheet P by the line sensor 25. In addition, the registration roller pair 26 moves in parallel in a lateral direction Fb so that the displacement amount becomes zero. That is, the registration roller pair serves as a sheet shift unit. Further, as illustrated in FIGS. 2A to 2C, in the lateral position correction, a direction in which the registration roller pair 26 is shifted is represented by + and −. The + direction is a right direction when viewing a downstream side from an upstream side in the conveying direction of the sheet P. The − direction is a left direction when viewing the downstream side from the upstream side in the conveying direction of the sheet P.

Figure 3A:
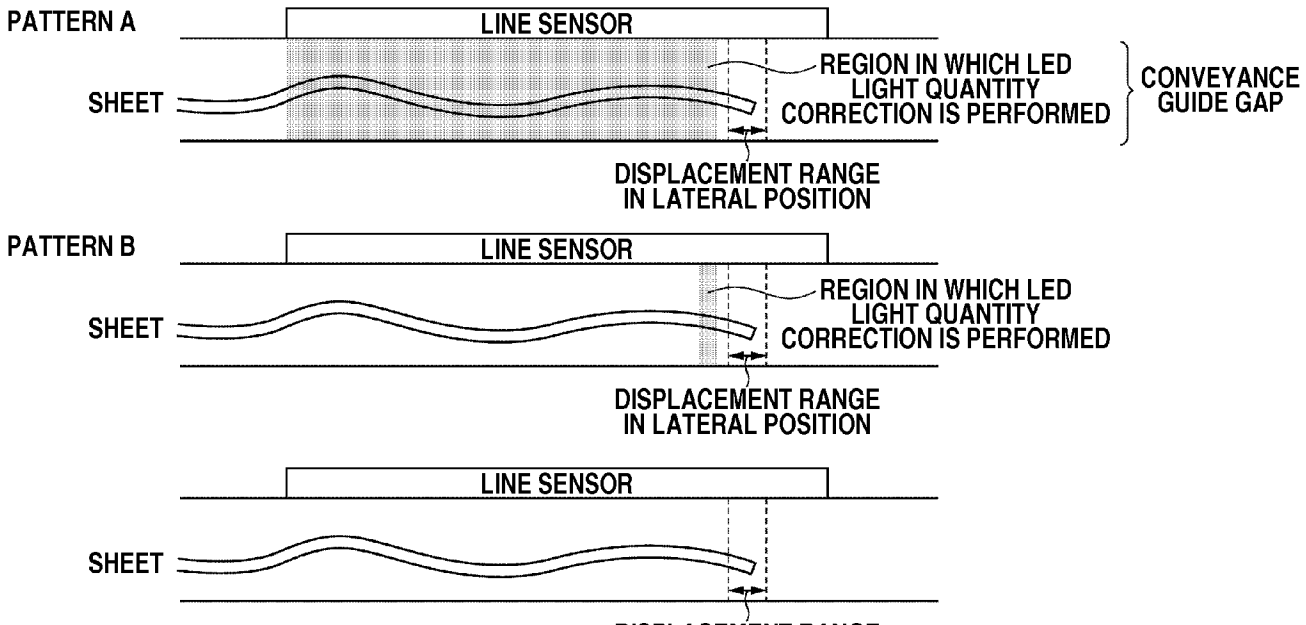
FIGS. 3A and 3B are diagrams illustrating a detection level according to a light quantity difference between a sheet and a region used for light quantity adjustment of the line sensor.
Figure 3B:
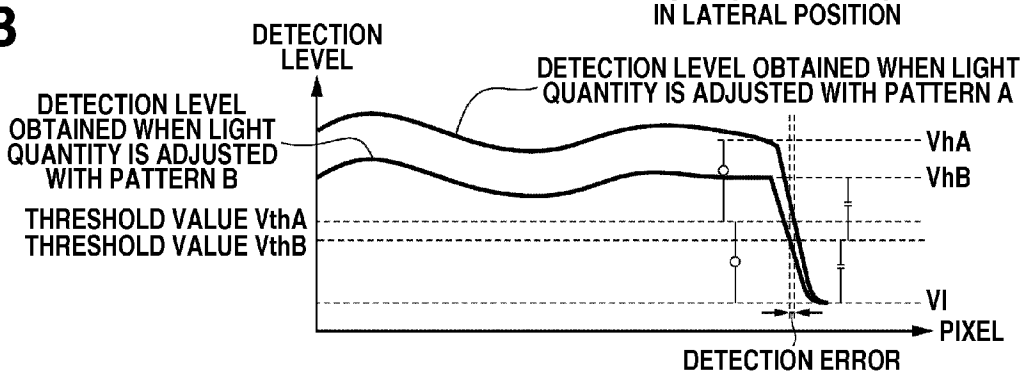

FIGS. 3A and 3B are schematic diagrams illustrating a relationship between a region used for light quantity adjustment of the line sensor 25 for detecting the side edge position of the sheet and a reflected light quantity according to the adjustment result. FIG. 3A illustrates the relationship between the line sensor and the sheet when viewing the upstream conveying direction from the downstream conveying direction, in the conveying path illustrated in FIGS. 2A to 2C.

Since the sheet is nipped by the plurality of rollers that is disposed apart from each other in a width direction, the sheet waves in a width direction, and a distance between the line sensor 25 and the sheet varies according to the position of the pixel. As illustrated in a pattern A illustrated in FIG. 3A, when the light quantity adjustment is performed over the entire region where the line sensor 25 faces the sheet, the light quantity may be insufficient according to the position of the pixel. For this reason, the light quantity adjustment may not be performed appropriately. In general, when the reflected light quantity from the sheet is less than an output saturation level, the light quantity of the light source of the sensor is desirably set to be close to the output saturation level in the viewpoint of an S/N ratio. However, as the result of performing the light quantity adjustment over the entire region where the line sensor 25 faces the sheet, when the light quantity is set to be high, the detection level of the sensor is increased in the vicinity of the sheet edge as in the pattern A in FIG. 3B. To the contrary, when the light quantity is set to be low, the S/N ratio is reduced. In a pattern B, based on the size of the sheet in the width direction, a region X in which the light quantity adjustment is performed is determined and the light quantity adjustment is performed within the region. The region used for light quantity adjustment X is the reading pixels of the line sensor facing a predetermined range apart by a predetermined distance to a central side of the sheet from the target position of the side edge position of the sheet according to the size of the sheet in the width direction. The predetermined distance is a distance according to a range of the assumed displacement of the sheet in the lateral position and is a slightly longer distance than a maximum value of the assumed displacement amount in the lateral position. In the present exemplary embodiment, the number of pixels corresponding to the predetermined range is set to be 240, so that the pixel is in a range of about 5 mm. In addition, the line sensor 25 has about 6,000 pixels and a length of about 125 mm.

Therefore, even though the displacement amount of the sheet in the lateral position is the assumed maximum displacement amount, since the light amount adjustment is performed using the output from the reading pixels at a position near the side of the sheet, the effect due to a variation of the detection level by the waving of the sheet can be suppressed minimally and the appropriate light quantity adjustment can be performed.

As illustrated in FIG. 3B, the side edge position of the sheet P is a position of a light receiving element at which an analog signal level becomes a median value between the detection level of the reflected light quantity from the sheet P and the detection level of the reflected light quantity from the conveying guide outside the sheet P. To calculate a threshold value for detecting the side edge position, a value, which is a half of the sum of a detection level Vh of the reflected light quantity from the sheet P and a detection level Vl of the reflected light quantity from the conveying guide, is set as a threshold value Vth. That is, the position of the pixel at which the analog output of the line sensor becomes Vth is determined as the side edge position. The reading pixels used for the light quantity adjustment are also used for determining the threshold value.

Figure 4:
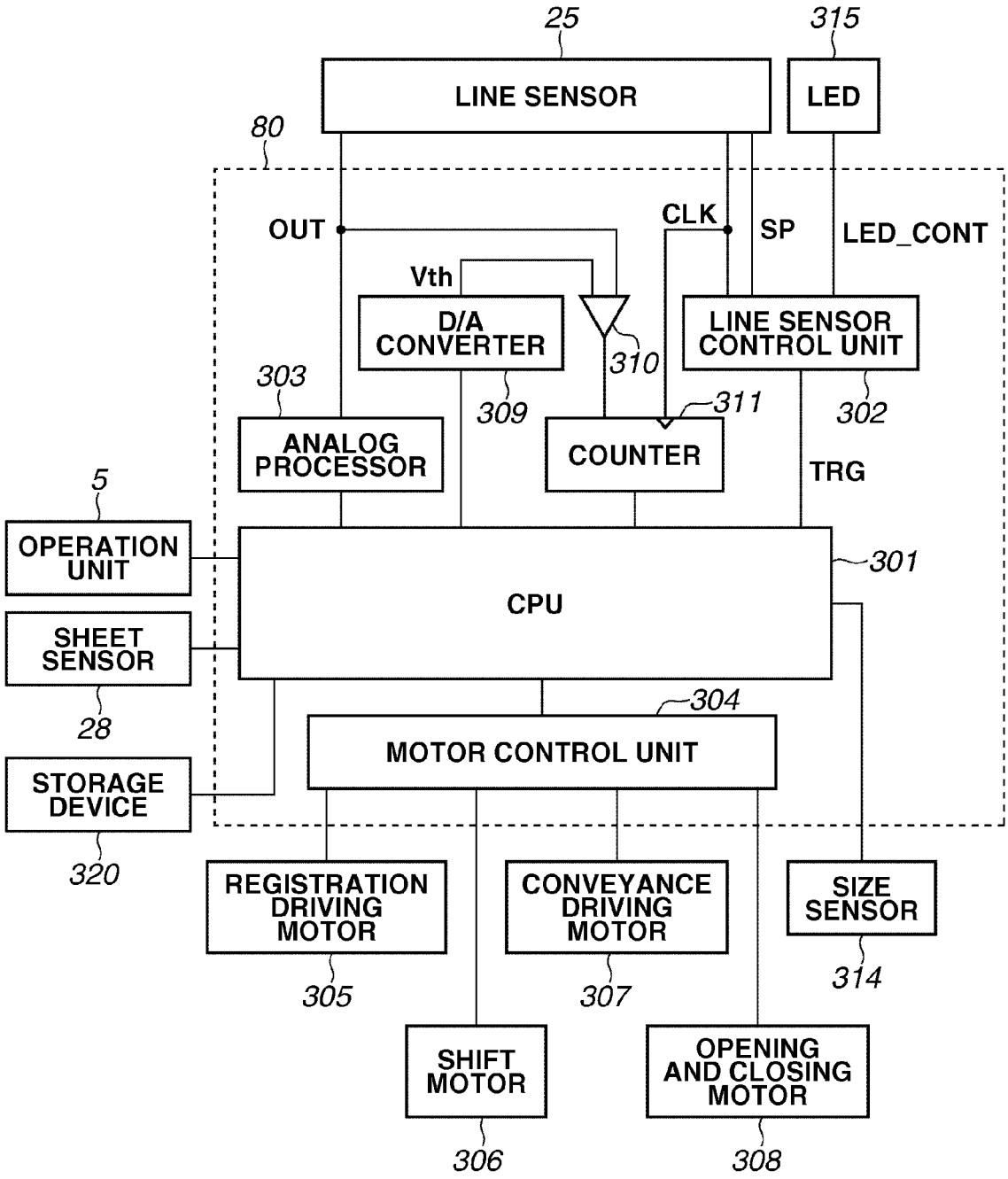
FIG. 4 is a block diagram illustrating a control configuration associated with the lateral position correction.

Operations of the units that take part in the skew correction and the lateral position correction will be described with reference to FIG. 4. A central processing unit 301 acquires an instruction from an input device of the operation unit 5 or displays information on a display device of the operation unit 5. The CPU 301 acquires size information indicating the size (for example, a standard size or a length in the conveying direction and the width direction) of the sheet P from the operation unit 5 or a size sensor 314. The size sensor 314 is mounted in the conveying path or the sheet feeding cassette 21 and detects the size of the sheet P. The CPU 301 recognizes that the leading edge of the sheet P reaches the sheet sensor 28 when the sheet sensor 28 outputs the detection signal. The CPU 301 starts the control of the conveying driving motor 307 and the opening and closing motor 308 or the skew correction and the lateral position correction, based on the timing when the leading edge of the sheet P reaches the sheet sensor 28. The conveying driving motor 307 rotates the conveying roller pair 27. The opening and closing motor 308 is opens and closes the conveying roller pair 27.

The CPU 301 resumes the rotation of the registration driving motor 305 using the motor control unit 304 at the rotation resuming timing of the registration roller pair 26 while specifying a shift quantity (distance α) in the lateral position correction. In addition, the CPU 301 drives the shift motor 306 using the motor control unit 304 so that the sheet P moves by the distance a in the lateral direction.

The CPU 301 uses a light-emitting diode 315 as the light source and the line sensor 25 so as to specify the side edge position of the sheet P. That is, the CPU 301 serves as a position detection unit that detects the side edge position of the sheet.

When the line sensor 25 is driven, the CPU 301 outputs a trigger signal TRG to a line sensor control unit 302. When the trigger signal TRG is input, the line sensor control unit 302 outputs a control signal, which is required to drive the line sensor 25, to the line sensor 25. As the control signal, there are a clock signal CLK, a start pulse SP, an LED control signal LED_CONT, and the like. The LED control signal LED_CONT is a signal for turning on the LED 315 and performing the light quantity adjustment. When the clock signal CLK and the start pulse SP are input, the line sensor 25 sequentially reads the signals output from each pixel of the line sensor 25, to output a time-series output signal OUT. The output signal OUT is an analog signal and is input to an analog processor 303 and a comparator 310. The analog processor 303 converts the output signal OUT, the analog signal, into the digital signal and outputs the converted digital signal to the CPU 301.

The CPU 301 determines the region of the reading pixel of the line sensor 25 to perform the light quantity adjustment of the LED 315, based on the size information in the width direction of the sheet acquired from the size sensor 314 or the operation unit 5. That is, the CPU 301 serves as a light quantity adjustment region determination unit. The output signal OUT from the line sensor 25 is input to the analog processor 303 and is converted into a digital signal, which is input to the CPU 301. The line sensor control unit 302 drives the LED 315 using a plurality of predetermined light quantities (driving current). Based on the level of the reflected light quantity at each driving current, the line sensor control unit 302 adjusts the light quantity of the LED 315 so that a maximum value of the output signal output from the pixel of the above-described determined region becomes a predetermined value. That is, the line sensor control unit 302 serves as the light quantity adjustment unit. The function of the line sensor control unit 302 may be mounted in the CPU 301.

After the light quantity adjustment is completed, the CPU 301 perform a comparison of the levels of the output signals from the line sensor 25 to determine the maximum value Vh and the minimum value Vl and determine a median value between the maximum value and the minimum value to be the threshold value Vth. The maximum value Vh is an output from the reading pixel facing the sheet, and the minimum value Vl is an output from the reading pixel not facing the sheet. The CPU 301 outputs the threshold value Vth to a digital-to-analog converter 309. That is, the CPU 301 serves as a threshold value determination unit. The D/A converter 309 outputs a voltage corresponding to the threshold value Vth to the comparator 310. The comparator 310 compares the threshold value Vth with the output signal OUT to perform binarization.

As such, the comparator 310 serves as a binarization unit that compares the signals output from the plurality of pixels of the line sensor 25 with the determined threshold value to binarize the corresponding signal. When the output signal OUT exceeds the threshold value Vth, the comparator 310 outputs a high-level signal, and when the output signal OUT does not exceed the threshold value Vth, the comparator 310 outputs a low-level signal. A counter 311 is operated by the clock signal CLK output from the line sensor control unit 302. The counter 311 counts the time when the binarization signal is at a high level and outputs the counted value to the CPU 301, according to the clock signal CLK. The CPU 301 specifies the side edge position of the sheet P based on the counted value.

Further, the CPU 301 calculates the difference (displacement amount in the lateral position) of the side edge position with respect to the target position and the displaced direction. The CPU 301 converts the displacement amount in the lateral position into the number of pulses of the shift motor 306 and outputs the number of pulses and data in a driving direction in which the shift motor 306 is driven to the motor control unit 304. The motor control unit 304 drives the shift motor 306 according to the driving direction and the number of pulses.

Figure 5:
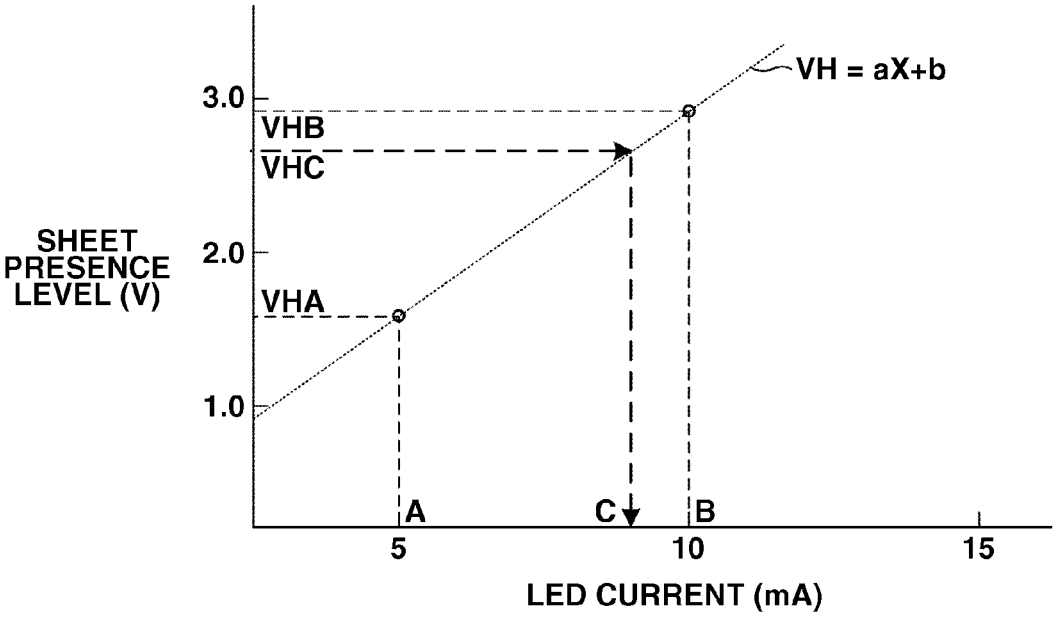
FIG. 5 is a diagram illustrating light quantity setting.

FIG. 5 is a conceptual diagram of a light quantity setting calculation in the present exemplary embodiment. First, the line sensor control unit 302 outputs the start pulse SP along with the output of the control signal LED_CONT so that the driving current of the LED 315 becomes A (mA). The LED 315 irradiates the conveyed sheet with light in a first light quantity, and the line sensor receives the reflected light. The CPU 301 samples the output level of the line sensor 25 receiving the reflected light from the sheet and determines a sheet presence level VHA (first output). Herein, the pixel range in which the sampling is performed is the pixel in the region X in which the light quantity adjustment determined from the size information of the sheet described with reference to FIGS. 3A and 3B is performed.

Next, the line sensor control unit 302 outputs the control signal LED_CONT so that the driving current of the LED 315 becomes B (mA). The LED 315 irradiates the conveyed sheet with light in a second light quantity, and the line sensor receives the reflected light. The CPU 301 samples the reflected light quantity from the sheet and determines a sheet presence level VHB (second output). The CPU 301 determines coefficients a and b in a linear expression VH=aX+b representing the relationship between the LED light quantity and a sheet presence level, from the sheet presence level VHA or VHB, when the driving current of the LED 315 is A or B. The CPU 301 obtains the driving current of the LED 315 that is a target sheet presence level VHC from the determined expression. The VHC is set to a value obtained by adding the VHA to 80% of the difference between the VHB and the VHA, but may be set to a value between the VHB and the VHA.

Further, the values of the VHA and the VHB may be changed according to a material of the conveyed sheet. The material of the sheet is previously set by a user from the operation unit 5.

Figure 6:
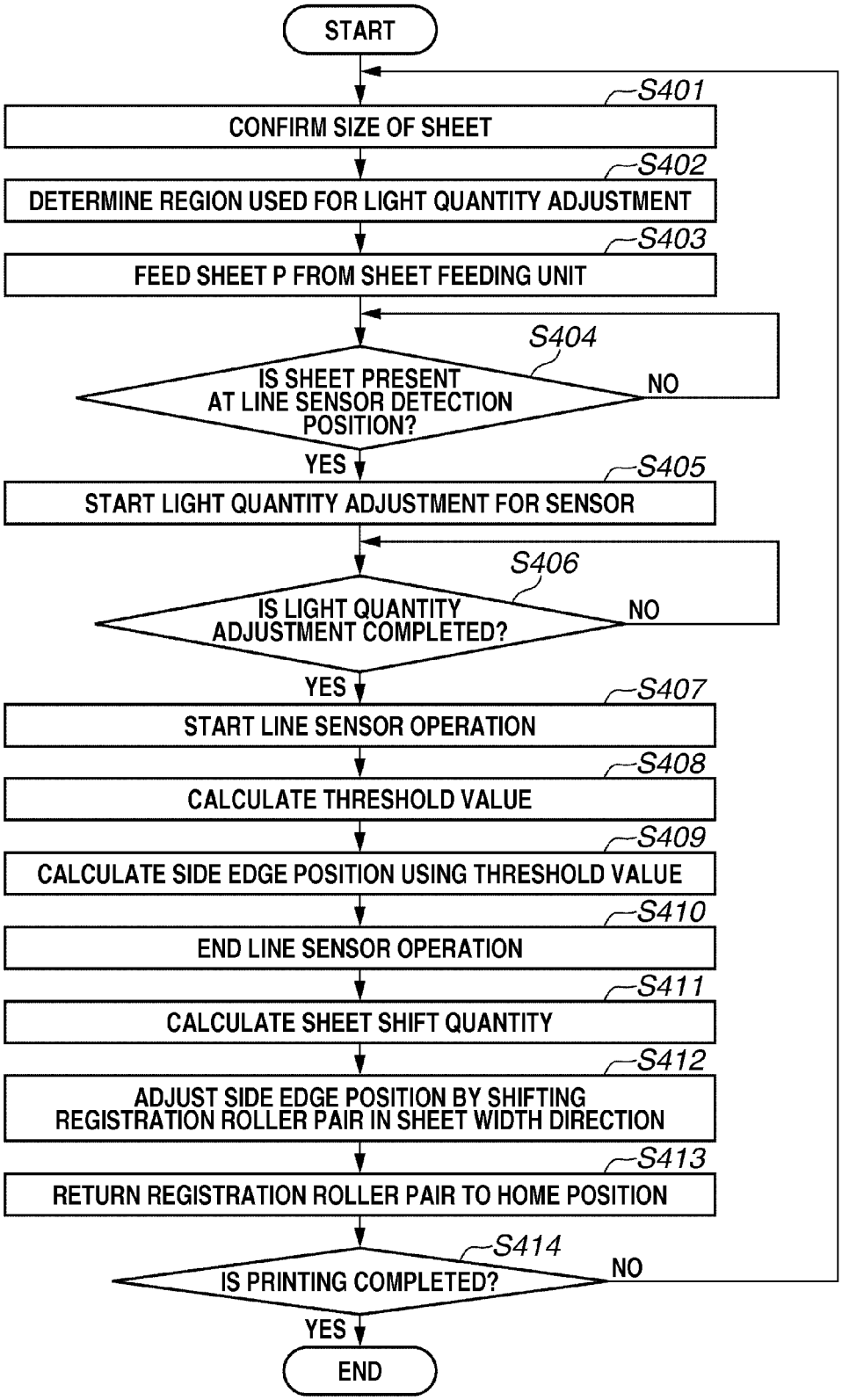
FIG. 6 is a flow chart illustrating a control operation of the lateral position correction.

FIG. 6 is a flow chart illustrating a control operation associated with the lateral position correction. The following operation is performed by the CPU 301 in FIG. 4.

First, the CPU 301 acquires the size of the sheet P that is present in the sheet feeding unit (in step S401) and determines the region of the reading pixel of the line sensor 25 used for the light quantity adjustment based on the width direction size of the sheet (in step S402). Further, the CPU 301 conveys the sheet P from the sheet feeding unit (in step S403) and determines whether the sheet P is conveyed to the position of the line sensor 25 (in step S404). After the leading edge of the sheet P is detected by the sheet sensor 28, when the time according to the distance between the sheet sensor 28 and the line sensor 25 lapses, the CPU 301 determines that the sheet P is conveyed to the position of the line sensor 25 and then When the sheet P is conveyed to the position of the line sensor 25, the CPU 301 instructs the line sensor control unit 302 to transmit the clock signal CLK, the start pulse SP, and the LED control signal LED_CONT to the line sensor 25. The CPU 301 also informs the line sensor control unit 302 of the range in which the light quantity adjustment is performed.

When the line sensor control unit 302 receives the instruction from the CPU 301, the line sensor control unit 302 transmits the clock signal CLK, the start pulse SP, and the LED control signal LED_CONT to the line sensor 25. The CPU 301 starts the light quantity adjustment in the instructed range (in step S405). The CPU 301 waits until the light quantity adjustment is completed (in step S406). After the light quantity adjustment is completed, the CPU 301 instructs the line sensor control unit 302 to drive the line sensor 25 with the adjusted light quantity (in step S407).

Next, the CPU 301 determines the threshold value to detect the side edge position of the sheet based on the analog output signal from the line sensor 25 (in step S408). The CPU 301 compares the determined threshold value with the analog output signal to determine the position of the pixel of the line sensor 25 outputting the analog output signal corresponding to the threshold value to be the side edge position of the sheet (in step S409). The position of the pixel is determined based on the counted value by the counter 311 when the output of the comparator 310 is changed from a high level to a low level. Next, the CPU 301 instructs the line sensor control unit 302 to end the operation of the line sensor 25 (in step S410). The detection of the side edge position may be performed several times and the average value thereof may be taken. The CPU 301 determines the shift quantity to shift the sheet P in the width direction according to the difference between the side edge position of the determined sheet P and the target side edge position (in step S411). In addition, the CPU 301 shifts the registration roller pair 26 in a width direction and moves the side edge position of the sheet P to a target position in the state in which the conveying roller pair 27 is set to the separated state and the sheet P is nipped by the registration roller pair 26 (in step S412). Next, the CPU 301 conveys the sheet P by rotating the registration roller pair 26. When the sheet P passes the registration roller pair 26, the CPU 301 shifts the registration roller pair 26 in a width direction to move the registration roller pair 26 to a home position (in step S413). When all printings designated by a printing job are not completed, the process returns to step S401 and when all the designated printings are completed, the process ends (in step S414).

Figure 7:
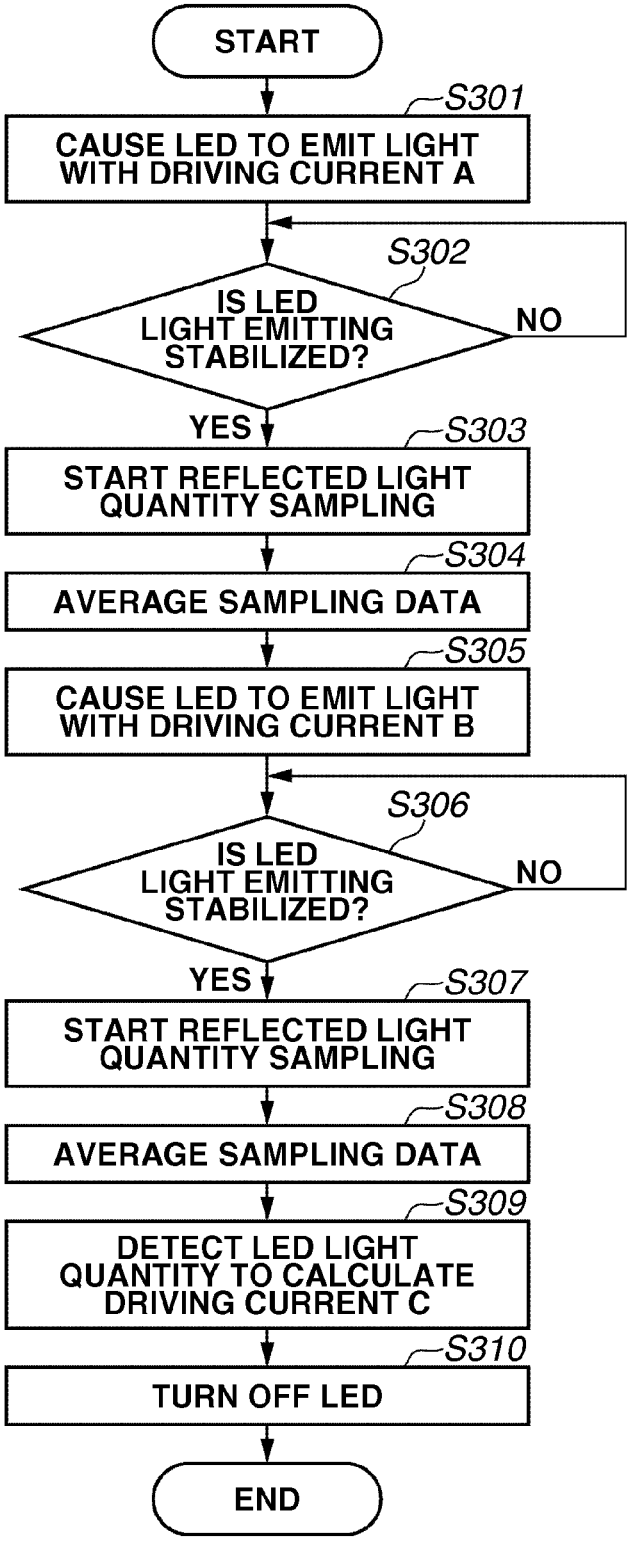
FIG. 7 is a flow chart illustrating the light quantity adjustment.

FIG. 7 is a flow chart illustrating in detail an operation of the light quantity adjustment of step S405 in FIG. 6, which is performed by the CPU 301.

The CPU 301 causes the LED 315 to emit light with driving current A (in step S301). After the stable driving time of the LED lapses (after 20 msec) (in step S302), starts the sampling of the sensor output VH of the sheet presence level (in step S303). The CPU 301 performs averaging processing on a plurality of sampling data and determines the averaging processed value to be the sheet presence level VHA at the time of light-emitting with the driving current A (in step S304). Next, the CPU 301 causes the LED 315 to emit light with driving current B (in step S305). The driving current B has a higher current value by a predetermined quantity than that of the driving current A. After the stable driving time of the LED lapses (in step S306), the CPU 301 starts the sampling of the sensor output VH of the sheet presence level (in step S307). The CPU 301 performs the averaging processing on the plurality of sampling data and determines the averaging processed value to be the sheet presence level VHB at the time of light-emitting with the driving current B (in step S308). The CPU 301 calculates driving current C by which the sheet presence level is to be VHC, based on the determined sheet presence levels VHA and VHB (in step S309). Next, the CPU 301 instructs the line sensor control unit 302 to turn off the LED 315 (in step S310) to complete the light quantity adjustment. The averaging processing of the sampling data is performed with the data of the pixel in the region X in which the light quantity adjustment determined from the size information of a sheet material illustrated in FIGS. 3A and 3B is performed. In addition, the driving currents A and B can be changed according to the type of sheet.

Figure 8:
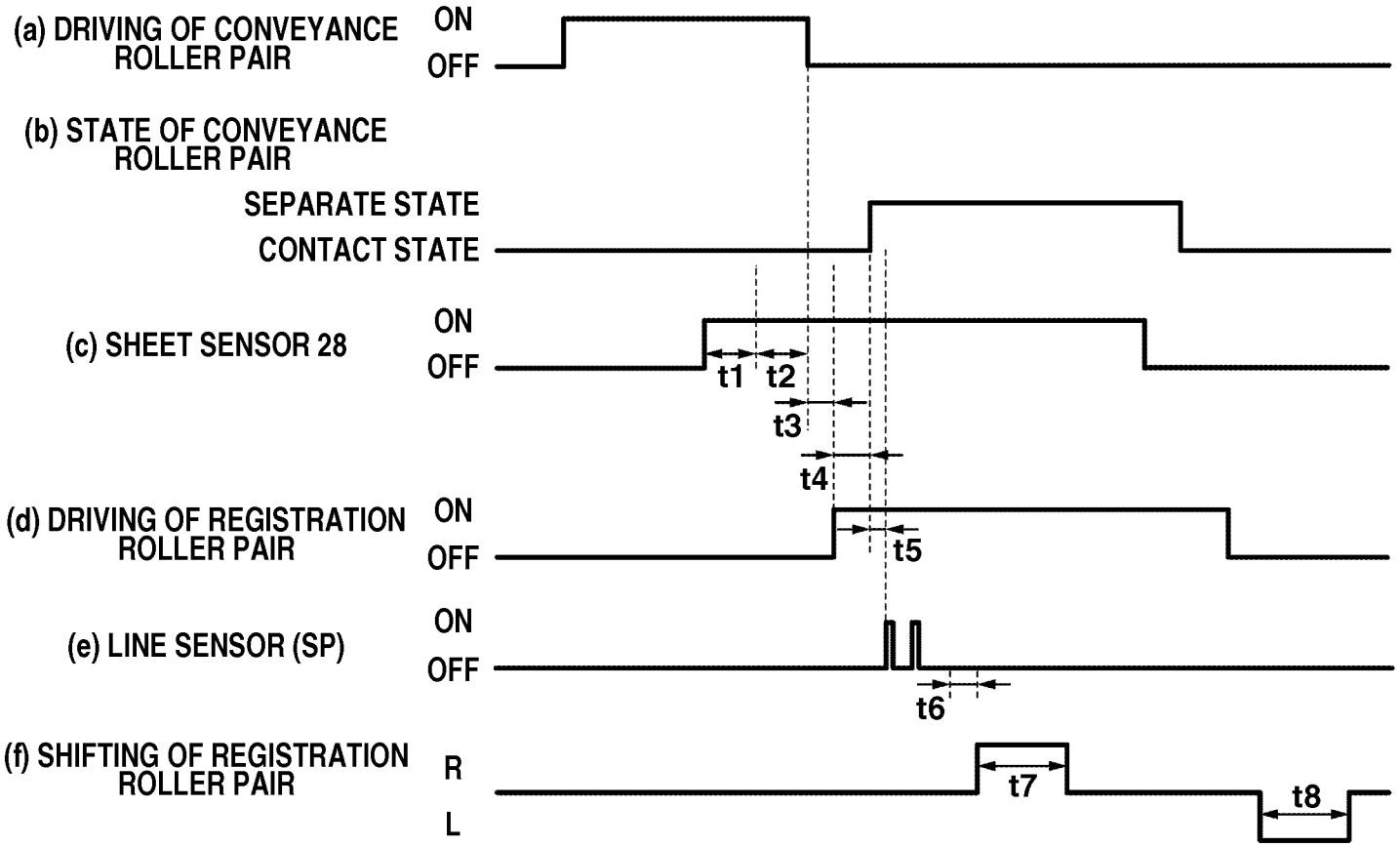
FIG. 8 is a timing chart associated with the lateral position correction.

FIG. 8 is a timing chart illustrating operations of each unit associated with the correction operation of the displacement in the lateral position.

Part (a) of FIG. 8 illustrates a driving state of the conveying roller pair 27. A section that is high-level ON indicates that the conveying roller pair 27 rotates. Part (b) of FIG. 8 illustrates a separate and contact state of the conveying roller pair 27. The section that is high-level ON indicates the state in which the conveying roller pair 27 is set to the separated state. Part (c) of FIG. 8 illustrates the detection result by the sheet sensor 28. The section that is high-level ON indicates that the sheet sensor 28 detects the sheet. Part (d) of FIG. 8 illustrates the driving state of the registration roller pair 26. The section that is high-level ON indicates that the registration roller pair 26 rotates. Part (e) of FIG. 8 illustrates an output state of the start pulse SP. When the start pulse SP is output, the line sensor 25 starts photographing for one line. Part (f) of FIG. 8 illustrates the state in which the registration roller pair 26 moves in a width direction. R indicates that the registration roller pair moves in the shift direction illustrated in FIG. 2C from the home position and L indicates that the registration roller pair moves in an opposite direction thereto.

The CPU 301 drives the conveying roller pair before the sheet P reaches the conveying roller pair 27. When a time t1 lapses after the leading edge of the sheet P is detected by the sheet sensor 28, the leading edge of the sheet P contacts the registration roller pair 26. Further, when a time t2 lapses, the CPU 301 stops the driving of the conveying roller pair 27. The sheet P is bent during the time t2 and the skewing of the leading edge of the sheet P is corrected. During a time t3 after the driving of the conveying roller pair 27 stops, the sheet P is bent. When the time t3 lapses, the CPU 301 drives the registration roller pair 26, such that the sheet P is nipped by the registration roller pair 26. At this time, the conveying roller pair 27 is in a closed (contact) state, and therefore the sheet P is bent. When a time t4 lapses after the registration roller pair 26 is driven, the CPU 301 sets the conveying roller pair 27 to the separated state. As a result, the sheet P is released and not bent and the skew in the trailing edge of the sheet P is calibrated. When a time t5 lapses after the conveying roller pair 27 is set to the separated state, the CPU 301 causes the line sensor control unit 302 to output the start pulse SP twice. A first start pulse SP is to adjust the light quantity and a second start pulses SP is to detect the side edge position. When a time t6 lapses after the side edge position detection is completed, the CPU 301 shifts the registration roller pair 26 in a width direction. When the side edge position is displaced in the + direction from the target position, the registration roller pair 26 is shifted to the target position in the – direction during a time t7. After the timing when the trailing edge of the sheet P passes the registration roller pair, the registration roller pair 26 is shifted to a home position HP in the + direction during a time t8.

As described above, according to the exemplary embodiment of the present invention, in the configuration of detecting the side edge position of the sheet using the line sensor, the light quantity correction is performed in the predetermined region in the vicinity of the side edge position of the sheet. This can prevent saturation of the output at the side edge position of the sheet caused by unevenness of the sheet or non-uniform sensitivity of the sensor. As a result, the side edge position of the sheet can be detected accurately, and the lateral position correction can be performed accurately.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-111730 filed May 15, 2012, which is hereby incorporated by reference herein in its entirety.

What is claimed is:

1. A sheet conveying apparatus, comprising:

a conveying unit configured to convey a sheet;

an acquisition unit configured to acquire a size of the sheet in a width direction orthogonal to a conveying direction of the sheet;

a light source configured to irradiate the sheet with light;

a line sensor configured to receive light from the light source and including a plurality of reading pixels for detecting a side edge position of the sheet in the width direction;

a determination unit configured to determine the reading pixels within a predetermined range facing the sheet in the line sensor as reading pixels to be used for light quantity adjustment of the light source based on the size acquired by the acquisition unit;

a light quantity adjustment unit configured to adjust a light quantity of the light source based on outputs from the reading pixels determined by the determination unit;

a threshold value determination unit configured to determine, after the light quantity is adjusted by the light quantity adjustment unit, a threshold value for detecting the side edge position of the sheet based on outputs from the reading pixels within the region facing the sheet in the line sensor and outputs from reading pixels within a region not facing the sheet; and a position detection unit configured to detect the side edge position of the sheet based on outputs from the plurality of reading pixels of the line sensor and the threshold value determined by the threshold value determination unit.

2. The sheet conveying apparatus according to claim 1, wherein the determination unit determines, as reading pixels to be used for the light quantity adjustment, the reading pixels within a predetermined range facing a position apart by a predetermined distance to a central side of the sheet from a target position of the side edge position of the sheet according to the size acquired by the acquisition unit.

3. The sheet conveying apparatus according to claim 2, wherein the predetermined distance is a distance according to a range of an assumed position displacement of the sheet in the width direction.

4. The sheet conveying apparatus according to claim 1, wherein the light quantity adjustment unit sets a light quantity so that an output of the reading pixel is to be a predetermined value between a first output and a second output, based on the first output of the reading pixel obtained when the light source irradiates the sheet with light in a first light quantity and the second output of the reading pixel obtained when the light source irradiates the sheet with light in a second light quantity.

5. The sheet conveying apparatus according to claim 1, wherein the reading pixel determined by the determination unit is also used to determine the threshold value by the threshold value determination unit.

6. The sheet conveying apparatus according to claim 1, wherein the predetermined range is a range nearer to the central side of the sheet than the displacement range of the side edge position of the sheet that is assumed according to the size acquired by the acquisition unit.

7. The sheet conveying apparatus according to claim 1, wherein the position detection unit detects the side edge position based on the position of the reading pixel at which the output of the reading pixel of the line sensor is to be the threshold value.

8. The sheet conveying apparatus according to claim 1, wherein the threshold value determination unit determines a value between the output of the reading pixel facing the sheet of the line sensor and the output of the reading pixel not facing the sheet to be the threshold value.

9. The sheet conveying apparatus according to claim 8, wherein the threshold value determination unit determines a median value between the output of the reading pixel facing the sheet of the line sensor and the output of the reading pixel not facing the sheet to be the threshold value.

10. The sheet conveying apparatus according to claim 1, further comprising:

a sheet shift unit configured to move the sheet to a predetermined position in the width direction based on the side edge position detected by the position detection unit.

11. The sheet conveying apparatus according to claim 4, wherein the light quantity adjustment unit changes the first light quantity and the second light quantity according to a material of the sheet.

12. An image forming apparatus, comprising:

a conveying unit configured to convey a sheet;

an acquisition unit configured to acquire a size of the sheet in a width direction orthogonal to a conveying direction of the sheet;

a light source configured to irradiate the sheet with light;

a line sensor configured to receive light from the light source and including a plurality of reading pixels for detecting a side edge position of the sheet in the width direction;

a determination unit configured to determine the reading pixels within a predetermined range facing the sheet in the line sensor as reading pixels to be used for light quantity adjustment of the light source based on the size acquired by the acquisition unit;

a light quantity adjustment unit configured to adjust a light quantity of the light source based on outputs from the reading pixels determined by the determination unit;

a threshold value determination unit configured to determine, after the light quantity is adjusted by the light quantity adjustment unit, a threshold value for detecting the side edge position of the sheet based on outputs from the reading pixels within the region facing the sheet in the line sensor and outputs from reading pixels within a region not facing the sheet;

a position detection unit configured to detect the side edge position of the sheet based on outputs from the plurality of reading pixels of the line sensor and the threshold value determined by the threshold value determination unit;

a sheet shift unit configured to move the sheet to a predetermined position in the width direction based on the side edge position detected by the position detection unit; and an image forming unit configured to form an image on the sheet moved by the sheet shift unit.

13. The image forming apparatus according to claim 12, wherein the determination unit determines, as reading pixels to be used for the light quantity adjustment, the reading pixels of a predetermined range facing a position apart by a predetermined distance to a central side of the sheet from a target position of the side edge position of the sheet according to the size acquired by the acquisition unit.

14. The image forming apparatus according to claim 13, wherein the predetermined distance is a distance according to a range of an assumed position displacement of the sheet in the width direction.

15. The image forming apparatus according to claim 12, wherein the light quantity adjustment unit sets a light quantity so that an output of the reading pixel is to be a predetermined value between a first output and a second output, based on the first output of the reading pixel obtained when the light source irradiates the sheet with light in a first light quantity and the second output of the reading pixel obtained when the light source irradiates the sheet with light in a second light quantity.

16. The image forming apparatus according to claim 12, wherein the reading pixel determined by the determination unit is also used to determine the threshold value by the threshold value determination unit.

17. The image forming apparatus according to claim 12, wherein the predetermined range is a range nearer to the central side of the sheet than the displacement range of the side edge position of the sheet that is assumed according to the size acquired by the acquisition unit.

18. The image forming apparatus according to claim 12, wherein the position detection unit detects the side edge position based on the position of the reading pixel at which the output of the reading pixel of the line sensor is to be the threshold value.

19. The image forming apparatus according to claim 12, wherein the threshold value determination unit determines a value between the output of the reading pixel facing the sheet of the line sensor and the output of the reading pixel not facing the sheet to be the threshold value.

20. The image forming apparatus according to claim 19, wherein the threshold value determination unit determines a median value between the output of the reading pixel facing the sheet of the line sensor and the output of the reading pixel not facing the sheet to be the threshold value.

* * * * *